United States Patent [19]

Waite

[11] 4,118,959

[45] Oct. 10, 1978

[54] HIDE PROCESSING MACHINE AND METHOD

[75] Inventor: Richard G. Waite, Red Wing, Minn.

[73] Assignee: S. B. Foot Tanning Company, Red Wing, Minn.

[21] Appl. No.: 809,099

[22] Filed: Jun. 23, 1977

[51] Int. Cl.[2] ..... C14C 15/00

[52] U.S. Cl. ..... 69/30; 69/21

[58] Field of Search ..... 69/30, 21; 68/208, 210

[56] References Cited

U.S. PATENT DOCUMENTS

| | | | |
|---|---|---|---|
| 50,228 | 10/1865 | Dean | 69/30 |
| 72,585 | 12/1867 | Ashcroft | 69/30 |
| 3,518,849 | 7/1970 | Eggleston | 69/30 |
| 3,665,735 | 5/1972 | Brennan | 69/30 |
| 3,670,534 | 6/1972 | Gould | 69/30 |
| 3,795,121 | 3/1974 | Cressman | 69/30 |
| 3,803,882 | 4/1974 | Brennan | 68/208 |

FOREIGN PATENT DOCUMENTS

| | | | |
|---|---|---|---|
| 453,763 | 6/1913 | France | 69/30 |

*Primary Examiner*—Alfred R. Guest
*Attorney, Agent, or Firm*—Lyon & Lyon

[57] ABSTRACT

An improved hide processing machine has a hide-treating drum supported for rotation about a central longitudinal axis to retain and tumble hides and treating fluids at a closed end of the drum. The drum includes helical partition means extending across the interior of the drum and spirally along the drum axis from its closed end toward its open end, thereby dividing the drum into at least two longitudinally-extending spiral compartments. The partition means prevents movement of hides from one such compartment to another during rotation of the drum, and includes fluid-transmitting openings for free movement of treating fluid between such compartments. The helical partition means can provide a conveying force for retaining or discharging such hides when the drum is rotated in an appropriate direction.

20 Claims, 5 Drawing Figures

HIDE PROCESSING MACHINE AND METHOD

BACKGROUND OF THE INVENTION

1. Field of the Invention

The field of the present invention involves hide processing equipment and particularly hide processing machines in which hides are tumbled within a generally cylindrical drum in the presence of a suitable processing fluid. One application of such processing is for the removal of hair from selected hides, such as steer hides. Such devices may also be used for other chemical treatment of hides at various stages in their total processing.

2. Description of the Prior Art

Hide processing machines are known, in which such a processing drum is rotated on its longitudinal axis and such axis is inclined somewhat to the horizontal, so that hides and processing fluid can be retained at one closed end of the drum and loaded or unloaded from an opposite open end of such a drum. To facilitate such loading and unloading, it has also been known to provide helical or spiral conveying flights along the peripheral inner surfaces of the drum. Such flights have normally extended from the drum wall only to a limited extent toward the central axis of the drum, so that the hides are free to tumble within the single large cylindrical compartment provided by the drum. One well-known prior art machine of this type is illustrated in U.S. Pat. No. 3,518,849. Various proposals have also been made for special arrangement of the inner edges of such spiral flights to achieve what were assumed to be desirable results in the nature of a "scudding" action as the hides tumble across the edges of such flights. Such arrangements are shown, for example, in U.S. Pat. Nos. 3,665,735; 3,670,534; 3,795,121; and 3,803,882.

SUMMARY OF THE INVENTION

Contrary to the emphasis in the prior art on the need for a so-called rubbing or scudding action between the hides and the inner edges of appropriate "flights" in such a hide processing drum, applicant has found that the tumbling of hides in such devices may result in undesired abrasion marks on the processed hides, particularly when large masses of hides of substantial weight are tumbled. This seems to occur as a result of the hides becoming partially folded upon themselves, and the folded hide edges then rubbing across an edge of one of the typical prior art conveying flights under conditions where the mass of other hides within the drum can cause a substantial pressure on such a folded hide edge and a resulting marked or marred area in the processed hide.

Such abrasion was found to be particularly noticeable when such a device was used to process large quantities of hides at one time, and applicant has found and believes that part of the problem has been the fact that the lowermost hides in such a drum are pressed against the edges of such flights by the entire mass of hides within the drum.

The present invention accordingly provides an improved hide processing machine of the type in which there is a hide treating drum with a generally cylindrical body portion, a closed end and an open end and means supporting the drum for rotation about the central longitudinal axis of said body portion with said axis inclined to the horizontal to retain and tumble hides and treating fluid at the closed end of the drum. Such a machine is provided with a helical partition means according to the invention which extends across the interior of the drum and spirally along the drum axis from the closed end of the drum toward its open end. The partition means effectively divides or separates the drum into at least two longitudinally-extending spiral compartments for tumbling a desired portion of a total load of hides entirely within at least one such compartment during rotation of the drum. The partition means further has fluid-transmitting openings for free movement of treating fluid between such spiral compartments, but the partition means prevents movement of hides from one spiral compartment to another during rotation of the drum. By extension of the partition means substantially entirely across the interior of the drum, and by the helical arrangement of such partition means, the present invention makes it possible to obtain a desired conveying effect in response to rotation of the drum in an appropriate direction, while at the same time eliminating the possibility of abrasion by engagement of hides with projecting edges of the previously-known types of conveying flights which were thought to be necessary to provide a wiping or scudding action. Moreover, the partition means of this invention tends to force the hides through the treating fluid during one portion of the rotation and to lift and drain the hides during another portion of the rotation, thereby enhancing the hide treatment.

The invention further contemplates the provision of such a helical partition means which constitutes a helical internal conveyor flight extending entirely across the drum interior and in which such flight further includes two diametrically opposite helical outer peripheral portions each having an outer edge secured to the inside peripheral surface of the drum, and an inner edge spaced inwardly from such outer edge and also spaced diametrically from the inner edge of the opposite peripheral portion, in combination with a central partitioning portion which bridges the diametrical space between the opposite inner edges and thus prevents the rubbing or abrasion of hides by engagement with such inner edges.

In order to facilitate loading and unloading of the device, the central portion of such a helical internal conveyor flight extends axially from the closed end of the drum to a location spaced axially inwardly of the drum from its open end, thereby providing a centrally unobstructed loading and discharge zone within the open end of the drum in an area where outer peripheral portions of the conveyor flight can still engage the hides and insure their movement completely out of the drum. Other features of the invention, including a preferred construction of such a helical partition means in a manner which permits convenient modification of prior art processing drums with helical flights which project only part way across the inner region of the drum, will be apparent from the following description, with particular reference to the accompanying drawings.

BRIEF DESCRIPTION OF THE DRAWINGS

In the drawings which form a part of this application, and in which like reference characters indicate like parts.

DESCRIPTION OF THE PREFERRED EMBODIMENTS

Figure 2:
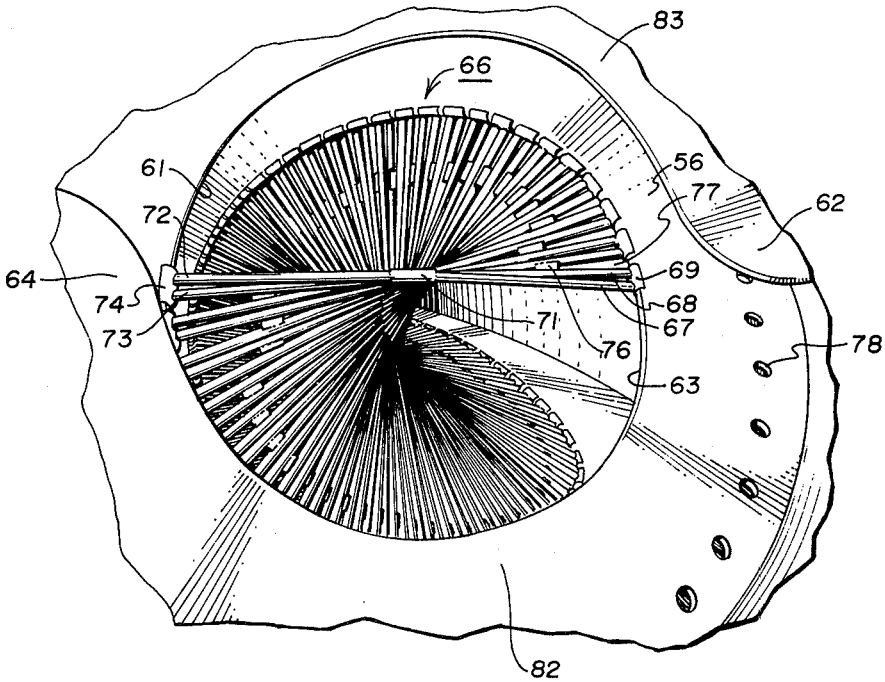
FIG. 2 is a partial perspective view, looking into the open end of the machine of FIG. 1, with the drum rotated substantially ninety degrees in a clockwise direction from the position of FIG. 1.
Figure 1:
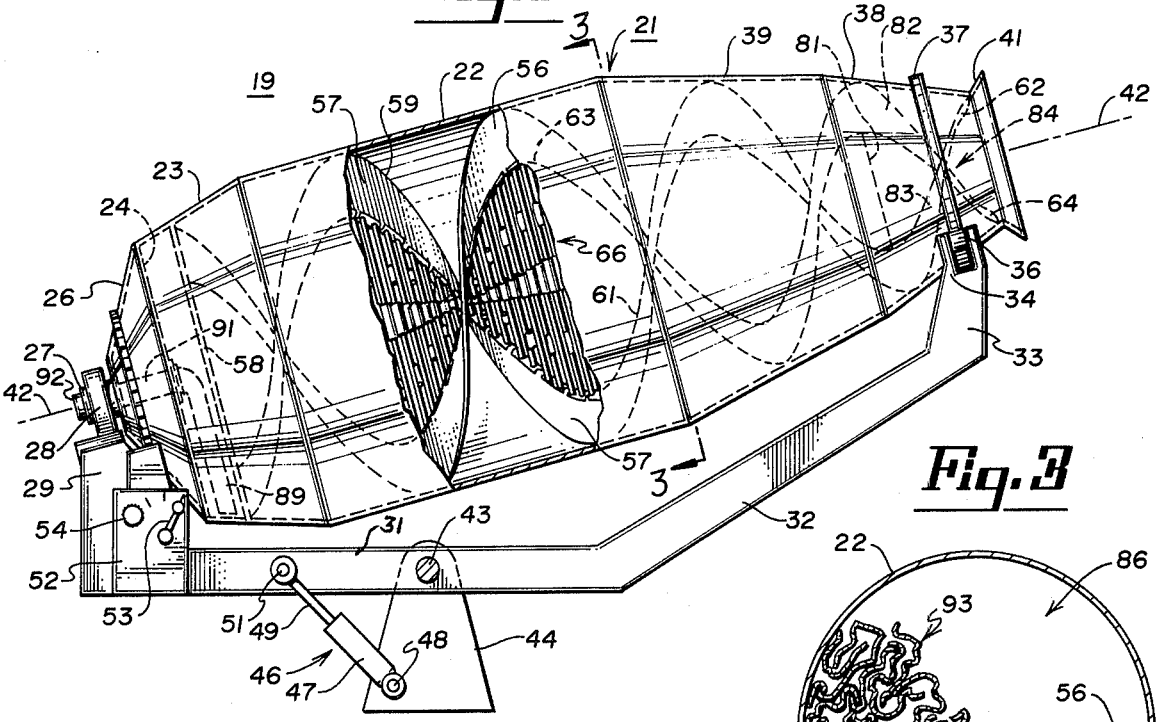
FIG. 1 is a partial side elevation, with portions broken away for clearness, of an improved hide processing machine according to the present invention.
Figure 3:
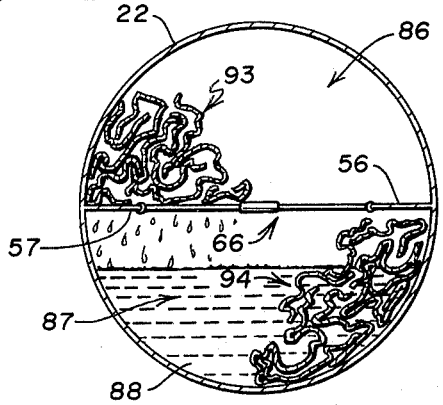
FIG. 3 is a sectional view on the line 3—3 of FIG. 1.

Referring first to the embodiment of FIGS. 1-3, the hide processing machine of the present invention is shown generally at 19 in FIG. 1 and includes a hide-treating drum 21 having a generally cylindrical body portion. The main body portion may be exactly cylindrical as shown at 22 and may include a somewhat tapered or narrowing circular base portion at 23 with a closed end wall 24 at the bottom or closed end of the drum. An end portion 26 includes a bearing shaft portion 27 which is coaxial with the longitudinal axis of the cylindrical drum and which is supported in an appropriate bearing 28 on a pedestal portion 29 of a supporting frame 31. The frame includes a forwardly and upwardly projecting portion 32 with a front support section 33 having spaced upwardly projecting portions 34 which support bearing rollers 36 at each side of the lower front portion of the drum. These bearing rollers 36 are engaged by a circular supporting flange 37 on the front end portion of the drum.

As shown in FIG. 1, the front portion of the drum may be a smaller cross section than the main cylindrical body portion 22 by providing a series of somewhat conical sections at 38 and 39, which terminate in a circular opening defined by the circular flange 41 at the upper or open end of the drum. While the exact cross-sectional dimensions of the drum may be constant and perfectly cylindrical throughout its length, or may be somewhat tapered at either end as shown, all of the sections are of circular cross section and have a common longitudinal axis 42—42 around which the drum is supported for rotation by the bearings previously described. The axis is preferably inclined with respect to the horizontal as shown in FIG. 1, and the angle of such inclination can be fixed or, as in the device shown, can be changed by virtue of the pivotal support 43 for the frame 31. The pivotal support 43 is carried by appropriate base members 44, and the desired tilting of the operating axis 42—42 may be achieved by any suitable power means 46, such as the hydraulic cylinder 47 pivoted at 48 to base 44 and having its piston rod 49 pivoted at 51 to the frame 31. The pivots 48 and 51 of the power means are spaced from pivotal support 43.

Rotation of drum 21 on its longitudinal axis is achieved through a driving connection which includes a ring sprocket or gear at the base of the drum engaged by a suitable driving chain or gear, respectively, which in turn is driven by an appropriate motor and gear box assembly 52. This driving unit preferably includes a reversing gear 53 and a variable speed control member 54. Thus the drum can be rotated in one direction during processing and tumbling of the hides within the closed end of the drum and can be rotated selectively in an opposite direction to provide a suitable conveying effect for unloading the drum through its open end 41, by virtue of the helical partition means next described. The description thus far is of a conventional hide processing machine of this inclined axis type and is equally applicable to the embodiment of FIGS. 4 and 5.

In the embodiment of FIGS. 1-3, the helical partition means of the invention has been illustrated as a modification and improvement of a prior art processing machine of the type in which diametrically opposed outer peripheral conveyor flight portions 56 and 57 extend spirally from a perforated baffle plate 58 near the closed end of the drum to the open end of the drum. These helical portions 56 and 57 thus constitute outer peripheral portions of the complete helical partition means according to the present invention. These outer peripheral portions each have an outer edge secured to the inside peripheral surface of the drum, as shown at 59 for portion 57. These outer peripheral portions or flights also each have an inner edge spaced inwardly from the outer edge and also spaced diametrically from the inner edge of the opposite peripheral portion or flight, as indicated by the inner edges of 61 of peripheral portion 57 and inner edge 63 of peripheral portion 56, respectively. As noted, the outer peripheral portion 56 extends substantially all the way to the open end 41 as shown at 64, and the peripheral portion 57 extends substantially all the way to the open end as shown at 62.

According to an important aspect of the present invention, the central space between the diametrically opposite inner edges 61 and 63 is bridged by a central partitioning portion 66 which extends generally diametrically across the central area and, in combination with the outer peripheral flight portions 56 and 57 forms essentially a single helical partition means constituting a helical internal conveyor flight extending entirely across the drum interior.

Details of a preferred arrangement of the central bridging portion for such a machine are further shown in FIGS. 1-3 of the drawings. With particular reference to FIG. 2, the central partitioning portion includes a plurality of diametrically-extending rods having outer ends secured to the opposite helical outer peripheral portions. Specifically the outer ends of these rods, such as 67 and 68, are secured to the opposite inner edges of the helical outer peripheral portions by appropriate connecting brackets 69 which may be welded or otherwise secured to the outer ends of the rods and to the inner edge 63, of peripheral portion 56, for example. The rod portions 67 and 68 extend radially inwardly and are secured near the central axis of the drum to a central holding sleeve or bracket 71 for each rod. A similar set of rods 72 and 73 extend outwardly in the opposite direction and have their outer ends secured to a connecting bracket 74 which, in turn, is secured to the inner edge 61 of the opposite helical outer flight portion 57. In the particular construction shown, the rods are assembled in pairs with each of the respective brackets 69 and 74, and these brackets are provided with a U-shaped external surface which is adapted to fit closely around the respective inner edges 63 and 61 of the outer flight portions. The parts may have a press fit at this point or may actually be welded in place. The use of the central sleeve member 71 for each pair of rods makes it possible to use rods which do not quite extend to the central axis of the drum and which therefore have some freedom of adjustment during assembly within the sleeves 71. Once the rods are in place with their outer brackets 69 and 74 secured to the outer peripheral sections, then they may be secured firmly by welding or other means to the central sleeves 71.

Since the hides processed within the drum of a machine of this type involve extremely heavy total weights, it is important that the helical partition means, including both the outer peripheral portions and the central bridging portion 66, should have sufficient strength and rigidity to resist deformation or breakage under such loads. To further strengthen the central partition means of the type shown in the drawing, the central sleeves 71 of axially adjacent rods are desirably welded or otherwise secured to each other along the central axis of the drum. Moreover, reinforcing spacers 76 are welded or otherwise secured to outer portions of the rods of adjacent pairs at a suitable location between the central axis and the outer ends of such rods. These spacers help prevent undesired flexing or separation of the individual rods and thus maintain the rods sufficiently close together to prevent penetration of hide portions between the rods in a manner which could cause the type of abrasion the present invention seeks to avoid. All of the rods, outer brackets, central sleeves and spacers are provided with smooth surfaces to avoid tearing or other damage to the hides. If necessary, the desired smoothness of such surfaces may be obtained by preliminary operation of such a processing machine with appropriate abrasive objects within the respective spiral compartments.

In the construction shown in FIGS. 1—3, the helical partition means is provided with fluid-transmitting openings in the form of suitable spacings at 77 between adjacent rods. These openings permit the free transfer of processing fluid from one helical compartment to the other. The outer peripheral conveying portions may also be provided with suitable openings at 78 to facilitate such fluid transfer.

According to an important feature of the invention, the central partitioning or bridging portion 66 extends substantially all the way from the closed end of the drum to a location at 81 which is spaced axially inwardly from the open end of the drum. At the same time, the outer peripheral portions or flights extend beyond the location 81 as illustrated at 82 for portion 56 and at 83 for portion 57. Thus the arrangement provides a centrally unobstructed loading and discharge zone 84 within the open end of the drum between the diametrically located outer peripheral portions of the conveyor flight. Hides may accordingly be fed into the open end of the drum while the drum is rotating and such hides will selectively enter one or the other of the longitudinally-extending spiral compartments 86 and 87 (FIG. 3) and will remain entirely within their respective compartments while the drum is rotated. A suitable processing fluid 88 may be introduced into and removed from the drum by a supply conduit 89 (FIG. 1) which has an inlet portion 91 coaxially arranged within the bearing shaft 27 and externally accessible at 92 for connection to a suitable fluid supply and removal system. During rotation of drum 22, the respective portions 93 and 94 of the total load of the hides to be processed accordingly remain within their respective spiral compartments 86 and 87. The advantages of such an arrangement include improved mixing and transfer of whatever chemicals are included in the processing solution 88, with one portion of the load at a time immersed in the processing fluid and the other portion given an opportunity as at 93 to drain while its portion of the spiral compartment is above the level of liquid 88. The weight of the hides which are in an upper portion of a spiral compartment at any given time cannot press on the hides in the corresponding lower compartment at that time. Thus the opportunity for mixing within the lower compartment is increased, and any tendency of the weight of upper hides to force the lower hides into abrasion-producing contact with the inner portions of the drum is likewise avoided.

In one example of experimental operation, in a processing drum of the type which, without the extension of a helical conveyor partition or flight entirely across the interior of the drum, could satisfactorily process only 15,000 pounds of hides at one batch operation, it was found that a total batch of 18,000 pounds could be processed satisfactorily when the total load was kept in separate spiral or helical compartments by the improved helical partition means of the present invention.

To further protect portions of individual hides from abrasion, the fluid-transmitting openings in said partition means have smooth edges and cross-sectional dimensions which substantially prevent the penetration of folded hide portions during rotation of the drum. In the rod arrangement shown, the rods are substantially adjacent each other along the central axis and should not be more than 1 to 1½ inches from adjacent rods at other locations spaced from the central axis of the drum. In general, it is believed preferable to limit the maximum cross-sectional dimension in at least one direction across the fluid-transmitting openings to a range from one-half inch to one inch.

Figure 4:
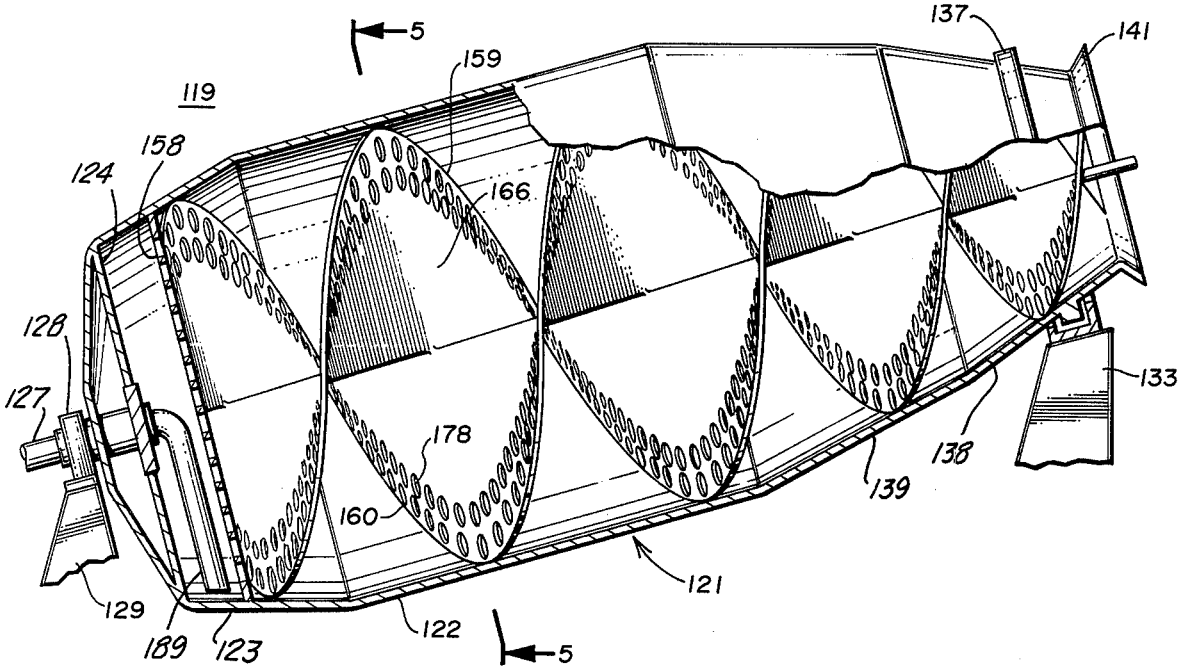
FIG. 4 is a partial side elevation similar to FIG. 1 showing a modified form of the improved hide processing machine of this invention.
Figure 5:
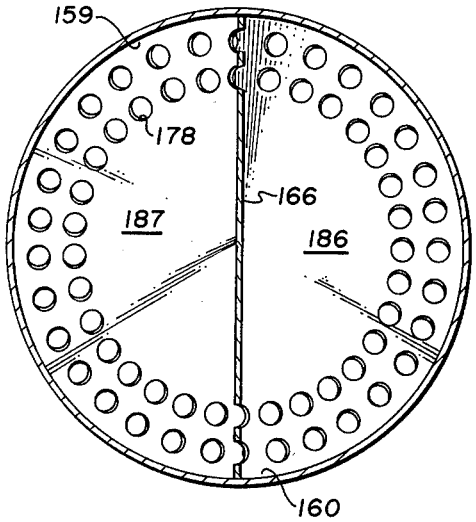
FIG. 5 is a sectional view on the line 5—5 of FIG. 4.

Referring now to the embodiment of FIGS. 4 and 5, like numbers in the one hundred series refer to like elements of the embodiment of FIGS. 1–3. This improved hide processing machine 119 includes a hide-treating drum 121 with a generally cylindrical body portion 122 and connical portions 123, 138 and 139 as described with respect to FIG. 1. The drum 121 is rotatably supported on the frame pedestal 129 by the bearing 128 and shaft 127 and on the frame supports 133 by the flange 137 and rollers (not shown). The end wall 124 and baffle 158 form a drainage chamber for the conduit 189. A flange 141 is provided on the open end. The foregoing is typical of a conventional hide processing machine of this inclined axis type. This embodiment differs from that of FIGS. 1–3 and conventional machines in that it is provided with spiral shaped central partition 166 comprised of a single plate extending across the diameter of the drum to divide the drum into the two compartments 186 and 187. For ease of fabrication, the partition 166 may be formed of two or more plates appropriately joined. The outer edges 159 and 160 of the partition 166 are connected to the inner wall of the drum 121. The partition 166 is provided with suitable openings 178 to allow the free flow of treating fluid from one compartment (186, 187) to the other but such openings are of a size to prevent the passage of hides therethrough. This embodiment accomplishes the same objectives of this invention as the embodiment of FIGS. 1–3 by separating the hides into compartments, precluding the scudding action by the edges of conventional fins and blades by eliminating such fin and blade edges, enhancing the repeated soaking and draining of the hides, complete mixing of the treating fluids, etc.

The invention has been described with reference to two preferred embodiments, one of which involves a construction suitable for original manufacture of the complete hide processing machine (FIGS. 4 and 5) and the other of which involves a construction suitable for modification of a prior art machine, but both provide at least one helical partition means extending entirely across the interior of the processing drum and spirally along the drum axis in such a way as to provide at least two longitudinally-extending spiral compartments for tumbling separate load portions of hides entirely within either or both of such compartments. Various modifications and alternate forms of construction for some of the features involved may be apparent to those skilled in the art, in light of the foregoing description, including the possibility of providing helical partition means of different constructions or even forming more than two longitudinally-extending spiral compartments. Other arrangements for modification of such prior machines may also be apparent to those skilled in the art, within the spirit and scope of the following claims.

I claim:

1. In a hide processing machine having a hide-treating drum with a generally cylindrical body portion, a closed end and an open end, means supporting the drum for rotation about the central longitudinal axis of said body portion with said axis inclined to the horizontal to retain and tumble hides and treating fluid at the closed end of the drum, the improvement comprising helical partition means extending across the interior of the drum and spirally along the drum axis from said closed end toward the open end and effectively partitioning the drum into at least two longitudinally-extending spiral compartments, and said partition means having fluid-transmitting openings for free movement of treating fluid between such spiral compartments.

2. A hide processing machine according to claim 1 having driving means for selectively rotating the drum in either direction around said axis, said helical partition means providing a conveying force tending to urge such hides out through the open end of the drum when the drum is rotated in one direction and toward the closed end when the drum is rotated in the opposite direction and thereby constituting a helical internal conveyor flight extending entirely across the drum interior.

3. A hide processing machine according to claim 2 in which said helical internal conveyor flight has an outer peripheral portion which extends from substantially the closed end of the drum to its open end, and in which said helical internal conveyor flight has a central portion which extends along said axis from substantially the closed end to a location spaced axially inwardly of the drum from said open end, thereby providing a centrally unobstructed loading and discharge zone within the open end of the drum between the outer peripheral portion of said conveyor flight and said axis.

4. A hide processing machine according to claim 2 in which said helical internal conveyor flight includes two diametrically opposite helical outer peripheral portions, each having an outer edge secured to the inside peripheral surface of the drum and an inner edge spaced inwardly from its outer edge and also spaced diametrically from the inner edge of the opposite peripheral portion, and a central partitioning portion bridging the diametrical space between said opposite inner edges.

5. A hide processing machine according to claim 4 in which said central partitioning portion includes a plurality of diametrically extending rods having outer ends secured to said opposite helical outer peripheral portions.

6. A hide processing machine according to claim 5 in which the outer ends of said rods are secured to the opposite inner edges of the helical outer peripheral portions, and the rods have central portions positioned successively along said axis and secured to each other along said axis.

7. A hide processing machine according to claim 6 in which said rods are arranged in pairs, with a connecting bracket at the outer ends of each pair, each connecting bracket having means securing it to the inner edge of a helical outer peripheral portion and to the corresponding outer ends of said pair of rods.

8. A hide processing machine according to claim 5 in which the fluid-transmitting openings include apertures in said helical outer peripheral portions of a dimension to substantially prevent the penetration of folded hide portions during rotation of the drum.

9. A hide processing machine according to claim 1 in which the fluid transmitting openings in said partition means have smooth edges and cross-sectional dimensions substantially preventing the penetration of folded hide portions during rotation of the drum.

10. A hide processing machine according to claim 9 in which the partition means comprises diametrically extending rods generally perpendicular to said axis, and said fluid transmitting openings are provided by limited spacing between said rods, said rods being axially substantially adjacent each other along said axis and being spaced not more than 1 to $1\frac{1}{2}$ inches from each other at other locations within the drum.

11. A hide processing machine according to claim 9 in which the maximum cross-sectional dimension in at least one direction across said fluid transmitting openings is substantially in the range from $\frac{1}{2}$ inch to 1 inch.

12. A hide processing machine according to claim 1 in which said helical partition means is comprised of plate means extending across the interior of the drum and forming said compartments.

13. A hide processing machine according to claim 12 in which said plate means extends diametrically across the interior of the drum to form two said compartments.

14. A hide processing machine according to claim 12 in which said fluid-transmitting openings include apertures in said plate means.

15. A hide processing machine according to claim 14 in which said apertures are located near the interior of the drum and are of a dimension to substantially prevent the penetration of folded hide portions during rotation of the drum.

16. A hide processing machine comprising a generally cylindrical drum for retaining treating fluid and mounted for rotation on the cylindrical axis, means for rotating the drum, partition means mounted in the drum and extending across the interior of the drum from substantially one end of the drum to the other to form at least two longitudinally-extending compartments, said partition means being helically shaped to form spiral compartments, and said partition means having fluid-transmitting openings for free movement of treating fluid between such compartments.

17. A hide processing machine according to claim 16 in which the axis of rotation is inclined from the horizontal during operation and the upper end of the drum is open.

18. A hide processing machine according to claim 17 in which said partition means extends from the lower closed end to near the open end of the drum.

19. In a hide processing machine having a generally cylindrical hide-treating drum for retaining treating fluid and mounted for rotation on the cylindrical axis to tumble hides, the improvement comprising partition means extending across the interior of the drum from substantially one end of the drum to the other to form at least two longitudinally-extending compartments, said partition means being helically shaped to form spiral compartments, and means for freely transmitting the treating fluid between such compartments during drum rotation.

20. A method of treating hides comprising the steps of: establishing a treatment zone in a rotary drum, confining a treating fluid in said zone without filling the drum, establishing at least two separate spiral-shaped compartments in the drum without scudder fins and in full fluid communication with each other, loading the compartments with hides, rotating the drum to repeatedly cause both circumferential and longitudinal movement of the hides through the treating fluid and lifting of the hides from the treating fluid for draining, and maintaining the hides in the separate compartments to divide the size of the load of hides that bears on any given hide to minimize damage to the hides.

* * * * *